US005544868A

United States Patent [19]

Randall et al.

[11] Patent Number: 5,544,868

[45] Date of Patent: Aug. 13, 1996

[54] BLOW PIPE AND GAS LANCE FOR BLAST FURNACE

[75] Inventors: Guy Randall, O Fallon; Gregory P. Calvin, Collinsville, both of Ill.

[73] Assignee: National Steel Corporation, Mishawaka, Ind.

[21] Appl. No.: 509,466

[22] Filed: Jul. 31, 1995

[51] Int. Cl.[6] ..... C21B 7/16

[52] U.S. Cl. ..... 266/47; 266/182; 266/225

[58] Field of Search ..... 266/47, 182, 187, 266/216, 217, 218, 265, 225

[56] References Cited

U.S. PATENT DOCUMENTS

| | | | |
|---|---|---|---|
| 3,626,501 | 12/1971 | Baird et al. | 266/187 |
| 3,758,090 | 9/1973 | Shimotsuma et al. | 266/225 |
| 4,921,532 | 5/1990 | Corbett et al. | 266/182 |
| 5,333,840 | 8/1994 | Skold et al. | 266/47 |
| 5,411,393 | 5/1995 | Askin et al. | 431/8 |

*Primary Examiner*—Scott Kastler

*Attorney, Agent, or Firm*—James L. Bean; Kerkam, Stowell, Kondracki & Clarke, P.C.

[57] ABSTRACT

An improved fuel lance and blow pipe system for injecting supplemental fuel into a blast furnace includes a lance support on the blow pipe housing by use of a quick disconnect coupling for releasably coupling the lance to the blow pipe and accurately fix the lance to discharge supplemental fuel into the hot blast. The coupling can be manually operated to disconnect the lance, without use of tools, to permit the lance to be retracted for inspection or replacement, or to facilitate packing of the tuyeres directing the hot blast into the furnace.

5 Claims, 3 Drawing Sheets

BLOW PIPE AND GAS LANCE FOR BLAST FURNACE

BACKGROUND OF THE INVENTION

1. Field of the Invention

This invention relates to a blow pipe and tuyere arrangement including a lance for injecting fuel into a blast furnace, and more particularly to a blow pipe and retractable lance including a quick disconnect coupling to enable positioning the lance in the blow pipe or tuyere for injecting fuel into the hot blast flowing into the furnace and retracting the lance without the use of tools.

2. Description of the Prior Art

It is known to employ a lance for injecting fuel into the hot blast flowing through a blow pipe and tuyere into a blast furnace to increase the temperature in the furnace and reduce the amount of coke required for the smelting process. Such lances normally are rigidly mounted in a fixed position with their outlet located to discharge the fuel in the hot blast stream, either in the blow pipe or in the tuyere, so that partial or complete combustion occurs before the injected fuel enters the furnace. U.S. Pat. No. 5,333,840 discloses one such blow pipe and lance arrangement wherein the lance comprises a pair of concentric tube members defining two separate flow paths including an inner path for a powdered coal suspension fuel and an outer path for an oxidizing gas. The two tubes are joined by a bellows-like compensator box which presumably is mounted on a flange on the outwardly projecting end of a guide tube in the wall of a blow pipe. U.S. Pat. Nos. 3,758,090 and 4,921,532 also show known lances for injecting fuel into the blow pipe of a blast furnace.

It is sometimes necessary to temporarily interrupt a blast furnace smelting operation, for example, for maintenance of the furnace or the charging system supported above the furnace. When this occurs, the hot blast through the blow pipes is interrupted, and it is conventional practice to pack the tuyere outlet with mud to prevent air from being drawn through the hot blast and tuyere system by the natural chimney effect of the furnace. To pack the tuyere, a port in the end of the blow pipe opposite the tuyere is opened and a manually manipulated elongated pusher or tamping tool is inserted to push balls of mud through the blow pipe and into position at the end of the tuyere where it is compacted against the hot charge materials in the furnace to provide a seal.

The presence of a lance projecting through the side of the blow pipe to a position near the center of the pipe presents a serious obstruction to packing the tuyeres. The obstruction not only requires the operator to remain for an undesirably long time in the hostile environment, but also frequently results in an incomplete or improperly sealed tuyere. Nevertheless, since the prior art lances such as those disclosed in the above-mentioned U.S. patents could not be readily retracted, it has been the conventional practice to attempt to manipulate the mud balls past the projecting lance tip to pack the tuyeres. It is, accordingly, a primary object of the present invention to provide an improved blow pipe and lance assembly including means retractably mounting the lance in the blow pipe.

Another object is to provide such an assembly including a manually operable quick-disconnect coupling for releasably securing the lance to the guide tube of the blow pipe to permit quick, easy connection and disconnection of the lance and blow pipe.

Another object of the invention is to provide such a blow pipe and lance assembly which allows for manual connection and disconnection of a flexible fuel supply hose to the lance without the use of tools.

Another object is to provide such an assembly in which the lance is lightweight and compact such that it may be inserted and retracted, without the use of tools, by a single worker.

Another object is to provide such an assembly which is of simple design, is relatively inexpensive to manufacture and is substantially maintenance free.

SUMMARY OF THE INVENTION

In the attainment of the foregoing objects and advantages, an important feature of the invention resides in providing a combination blow pipe and lance for supplying liquid or gaseous fuel such as natural gas to the hot blast flowing through the blow pipe or the tuyere into a blast furnace to reduce the coke requirement of the furnace. The blow pipe has a lance guide formed therein at an oblique angle to its longitudinal centerline for receiving and supporting an elongated lance pipe or tube. A guide pipe, or tube, has one end threadably received in a threaded nut rigidly welded to the blow pipe housing, and its other end threadably joined to the male end of a quick-disconnect coupling, such as a commercially available cam actuated Kam-Lock coupling. An elongated lance tube formed from a high temperature, erosion resistance material such as Inconel has its rear, or outwardly projecting end formed with male threads which are received in the female threads of a lance coupling adapter which, in turn, has male threads threadably engaging the female threads on the female member of the Kam-Lock coupling. The lance pipe, the female Kam-Lock coupling, and the lance coupling adapter are thus connected as a rigid assembly which may be releasably joined to the blow pipe by telescoping the lance pipe through the male Kam-Lock coupling and actuating the cam levers on the coupling to releasably but firmly connect the assembly to the blow pipe housing.

A pipe nipple has one end threaded into the end of the lance coupling adapter opposite the end receiving the lance pipe, and its other end threaded into the open end of the male member of a second Kam-Lock coupling. The female member of the second Kam-Lock coupling is joined, through suitable pipe nipples, to a check valve and a manual shut-off valve to a flexible pressurized natural gas supply line whereby the supply line may be manually connected to, or disconnected from the lance assembly by use of the second Kam-Lock coupling element.

When the lance pipe is installed and the blast furnace operating with gas fuel being supplied to the blow pipe, the manually actuated cam levers will normally be secured against inadvertent opening by use of lacing wire or other suitable means. When it is desired to remove the lance, for example, for inspection of the lance tube or for packing the tuyere with mud, it is only necessary to remove the lacing wire and manually lift the cam levers to release the lance. Thereafter, the external portion of the lance assembly may be grasped, using suitable hand protection, and manually withdrawn through the guide tube and male element of the Kam-Lock coupling. The lance may be completely withdrawn if necessary for inspection, or only partially withdrawn to remove any obstruction to mud balls being employed to pack the tuyere. Also, during extensive down time or periods when auxiliary fuel is not being used, the lance tube may be left in place, and the natural gas flow line disconnected by use of the second Kam-Lock coupling or other suitable quick-disconnect coupling in the manner described above, after having actuated the flow control valve to prevent escape of gas.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENTS

Figure 1:
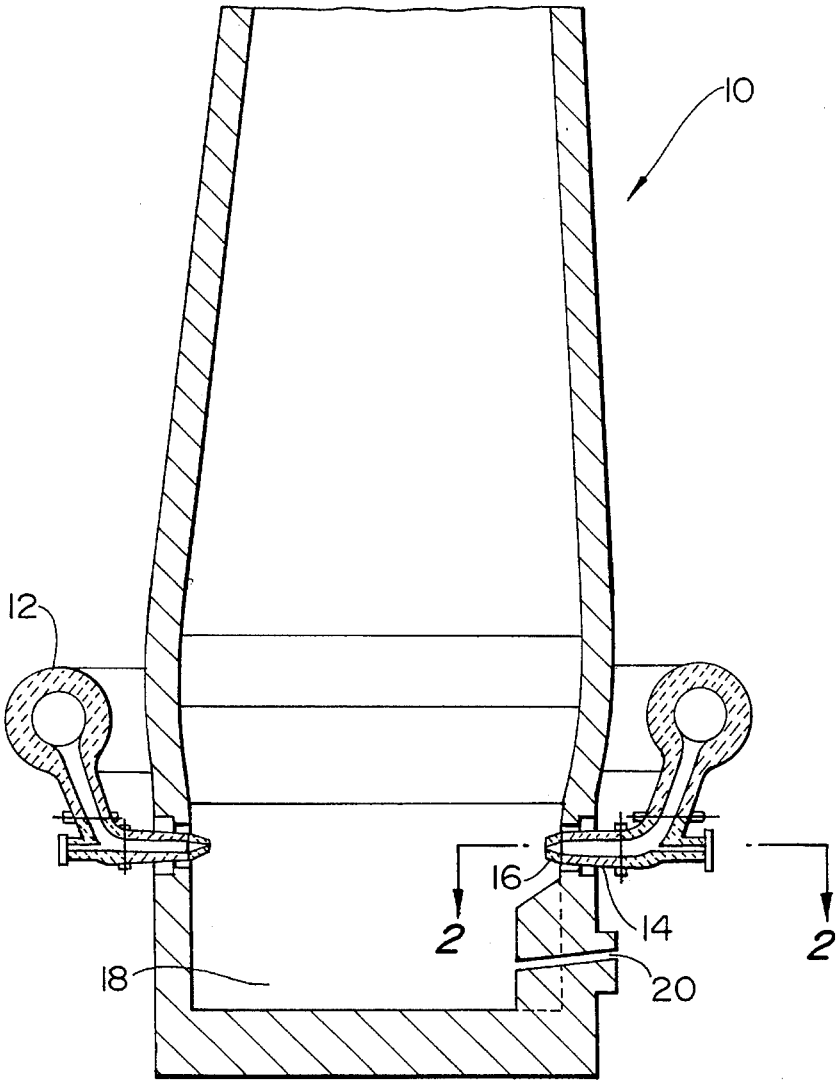
FIG. 1 is a partial schematic showing, in vertical section, of a blast furnace having a blow pipe and tuyere arrangement.
Figure 4:
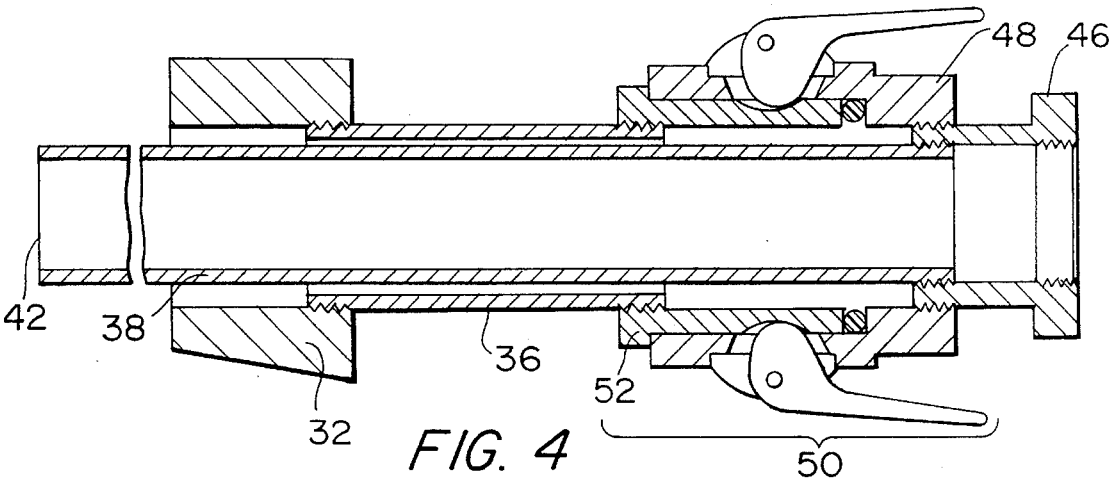
FIG. 4 is a further enlarged, fragmentary sectional view of a portion of a Kam-Lock coupling assembly suitable for use in accordance with the present invention.

Referring now to the drawings in detail, a vertical shaft blast furnace is illustrated schematically in FIG. 1, with the top portion of the furnace and the charging equipment omitted since this structure forms no part of the invention. The conventional annular hot blast distribution pipe 12 supplies high temperature air to the interior of the furnace through a plurality of blow pipes 14 and tuyeres 16. Molten pig iron, or hot metal, is tapped from the base 18 of the furnace through tap hole 20 in the conventional manner.

Figure 2:
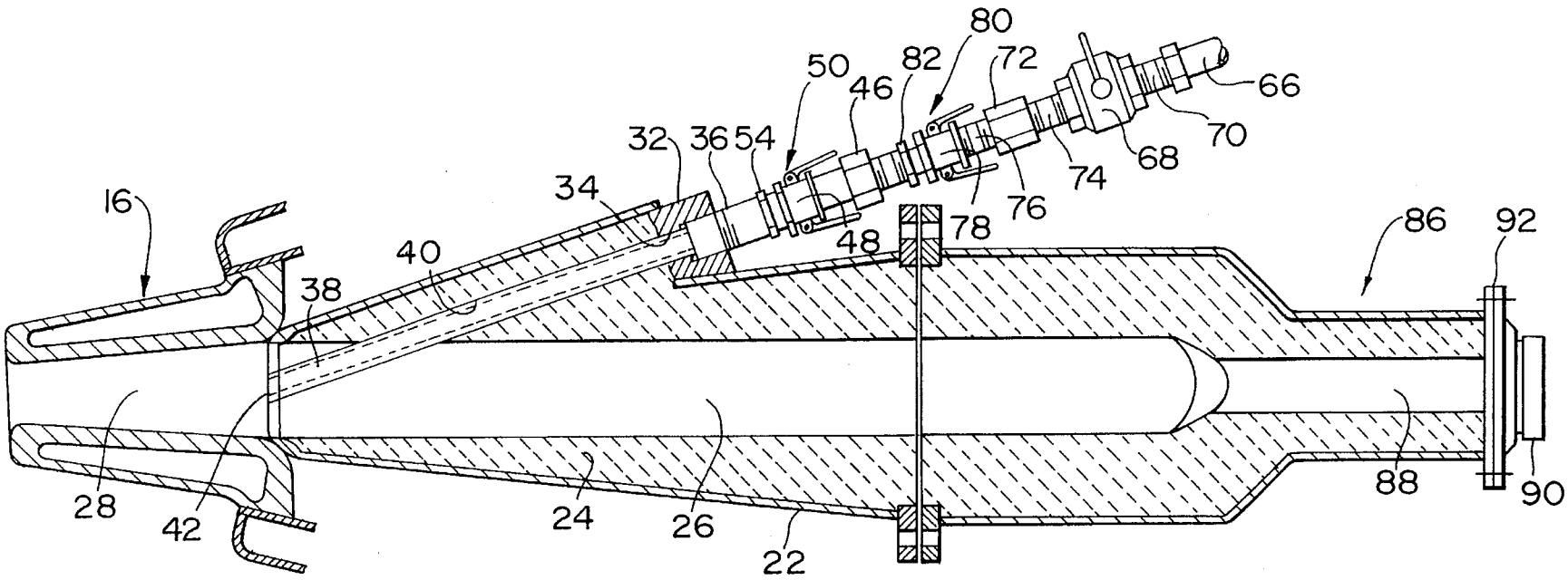
FIG. 2 is an enlarged sectional view of a portion of one of the blow pipe and tuyere arrangements employing a retractable gas lance according to the present invention.

In order to reduce the amount of coke required in the furnace, supplemental fuel may be injected into the hot blast flowing in the blow pipe and tuyere. Combustion of the supplemental fuel is at least commenced and may be substantially completed in the blow pipe and tuyere before being injected into the base of the furnace. As best seen in FIG. 2, the blow pipe 14 is in the form of a metal outer shell or casing 22 having a poured refractory lining 24 formed therein with a central cylindrical opening 26 extending therethrough in communication with a through opening 28 in tuyere 16. At the end opposite the tuyere, the blow pipe opening 26 is in communication with a central opening in a ceramic-lined conduit 30 connected to the blast distribution pipe 12.

A lance support nut or block 32 is rigidly welded in an opening in metal housing 22, and a threaded opening 34 extends through the block 32. A short length of pipe 36 is threaded into the opening 32 for telescopingly receiving a lance pipe or tube 38, with the lance tube extending through a cylindrical opening 40 in the refractory lining 24. As seen in FIG. 2, the lance tube projects into the central opening 26 of the blow pipe for the discharge of fuel into the hot blast flowing therethrough. For the discharge of natural gas, the end 42 of the lance tube preferably is positioned near the longitudinal centerline of the blow pipe and at a point near the entrance to the tuyere. It should be understood, of course, that depending upon flow rates, blast temperatures, and other factors, the exact location of the open end of the lance may vary. For example, the lance may terminate at a point spaced from the longitudinal centerline of the blow pipe, and the open end may be spaced farther from the end of the blow pipe, or may actually project into and discharge the fuel in central opening 28 of the tuyere 16.

The lance tube 38 is preferably made from a heat resistant metal such as Inconel which is capable of withstanding the high temperature and erosive action of the hot blast in the blow pipe.

Figure 3:
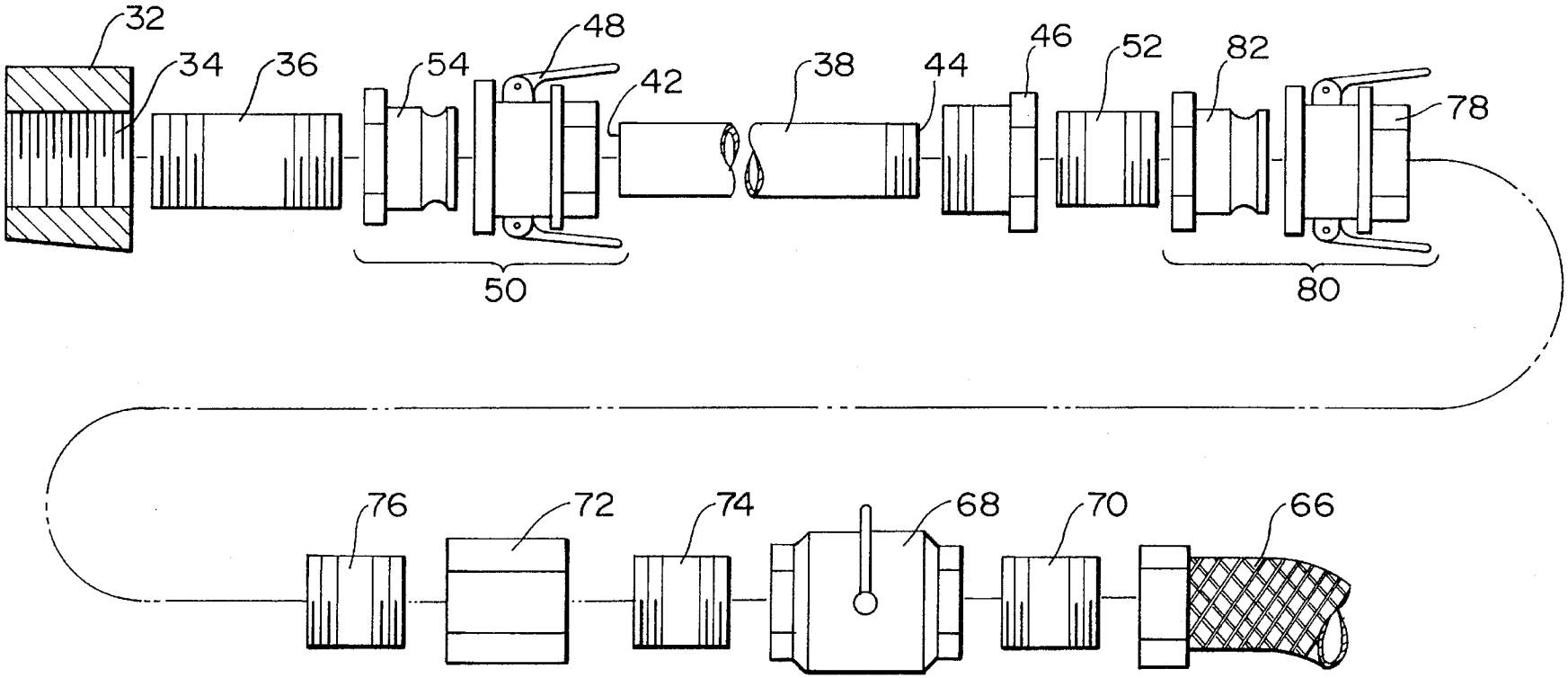
FIG. 3 is a further enlarged, exploded view of the improved gas lance, gas supply means, and lance support structure employed in FIG. 2.

The rearward, or outwardly projecting end 44 of lance tube 38 is provided with male threads which are threaded into female threads on one end of an adapter 46 as best seen in FIG. 3. Adapter 46 also has male threads on the same end which are threadably received in mating threads of the female element 48 of Kam-Lock coupling 50, while the opposite end of adapter 46 is also provided with female threads for receiving a pipe nipple 52. The outwardly projecting end of pipe member 36 has male threads which threadably engage female threads in the open end of the male element 54 of the Kam-Lock coupling 50.

To install the lance in the blow pipe, the lance tube 38, supported in the adapter 46 and projecting through the female cam lock member 48, is inserted in telescoping relation through male coupling member 54 and pipe 32 until the male and female coupling members are seated in assembled relation. In this position, the cam levers 56 are actuated to the locked position in which their cam lobes 58 engage the annular cam groove 60 to cam the assembly into locked, sealing relation with the end of member 54 telescoping into member 48 to engage and form a seal with a gasket member 62 carried within the bore of coupling member 48. Since tube 38 has a diameter smaller than the inner bore of coupling members 48 and 52, and has its end supported by an adapter threaded into the outwardly directed end of the female coupling member 48, the lance tube 38 projects through the coupling assembly to provide a gas flow path to the open end 42 of the lance tube within the central opening of the blow pipe. Thus, the adapter 46 enables the lance tube to project completely through the coupling assembly, with the male element of the coupling and the pipe section 36 acting as a guide to align the lance tube with the opening 40 in the refractory material 24. At the same time, adapter 46 cooperates with coupling member 48 to provide a seal preventing the escape of gases to the atmosphere.

A flexible stainless steel gas supply hose 66, having a manually operable shutoff valve 68 connected to the end thereof by a pipe nipple 70, provides fuel gas under pressure to the lance. The shutoff valve 68 is connected, through a one way check valve 72 and a pair of pipe nipples 74, 76, to the female element 78 of a second quick disconnect coupling element 80 which may be identical to connector 50. The male element 82 of coupling 80 is connected to the adapter 46 by pipe nipple 52.

By reference to FIGS. 2 and 3, it is seen that the fuel supply lance may easily be installed in the blow pipe by manually inserting the tube 38 through the male coupling member 54 to bring coupling elements 48 and 54 together, then actuating the cam levers 58 to lock the lance in place. Similarly, the lance may be completely or partially retracted 10 by releasing the cam levers 58 and withdrawing the lance. Valve 68 would, of course, be actuated to shut off the flow of gas before withdrawing the lance and the fuel supply hose 66 may be disconnected from the lance by way of the coupling 80 when desired, as when the lance will not be employed to inject fuel for an extended period of time. Also, in the event of loss of gas pressure during operation, check valve 72 will prevent the flow of hot blast gases back through the lance tube into the gas supply tube 66.

As best seen in FIGS. 1 and 2, the blow pipe assembly 14 is formed with a rearwardly projecting, refractory lined extension 86 having a central opening 88 extending therethrough, with the opening 88 in axial alignment with the blow pipe central opening 26. A closure member 90 is secured, by flanges 92, to the rearwardly projecting end of extension 86. Cover 90 may be removed to permit inspection of the interior of the blow pipe opening and refractory lining the tuyere, and the lance tube 38 during operation of the blast furnace. Also, when operation of the blast furnace is interrupted, and it is desired to pack the tuyere 16, balls of packing mud are inserted through the closure 90 and pushed along openings 88 and 26 and into the central opening 28 of tuyere 16 by use of an elongated pusher and packing tool which is manually operated.

In a typical blast furnace for the production of hot metal, the inside diameter of the blow pipe central opening 26 may be about 7 inches and the diameter of opening 88 may be about 4 inches, while the overall distance between the closure 90 and the end of the tuyere to be closed may be 8 feet or more. Thus, it is apparent that visibility is limited for manipulating the packing material into the tuyere. At the same time, the hostile environment at the base of an operating blast furnace, and in the vicinity of the blow pipes wherein the temperature in the central opening 26 may be in the range of 1,800° F., makes it imperative that the tuyere packing task be accomplished as quickly as possible.

In the past, the packing operation has been greatly complicated by the presence of a lance projecting into the opening of the blow pipe, or into the tuyere. In accordance with the present invention, however, the lance may be quickly and easily retracted to permit unobstructed pushing of the packing material into the tuyere. After the packing operation is completed, the lance may be easily reinserted and retained in position until resumption of blowing through the blow pipe is desired. At this point, the lance tube may again be retracted to permit ramming of the dried packing material through the tuyere and into the interior of the blast furnace, again using tools inserted through the access closure 90.

While the invention has been described with reference to a single tube lance useful for injecting gaseous or liquid fuel, it is believed apparent that other lance tube arrangements might be used, and that multiple lances may be employed in a single blast pipe. For example, one or more concentric tube lances such as that described in the above-identified U.S. Pat. No. 5,333,840 might be employed. Similarly, while the invention has been described with reference to a cam actuated quick disconnect coupling such as the commercially available Kam-Lock coupling, other quick disconnect couplings might be employed. Accordingly, while a preferred embodiment of the invention has been described, it should be apparent that the invention is not so limited, and it is intended to include all embodiments which would be apparent to one skilled in the art and which come within the spirit and scope of the invention.

We claim:

1. An improved fuel lance and blow pipe system for injecting supplemental fuel into a blast furnace, said system comprising a tuyere mounted in a wall of the furnace and providing an open passage into the furnace, a blow pipe including a metal case and a refractory lining having a central axial opening therethrough in communication with said tuyere providing a hot blast flow path through the blow pipe and tuyere and into the furnace, lance support means defining a lance guide opening extending through said metal case and refractory lining at an acute angle to said central axial opening and in the general direction of said open passage into the furnace, said lance support means including mounting means on said metal casing, an elongated lance having an open end, said elongated lance being adapted to be telescopingly received in said lance guide opening and releasably supported by said lance support means with said open end within said hot blast flow path, manually operable cam actuated quick disconnect coupling means releasably connecting said lance on said lance support means, said coupling means being operable to release said lance to permit withdrawal of the lance from said hot blast flow path, and fuel supply means for supplying supplemental fuel to said lance to be discharged from said open end into said hot blast flow path.

2. An improved fuel lance and blow pipe system for injecting supplemental fuel into a blast furnace, said system comprising a tuyere mounted in a wall of the furnace and providing an open passage into the furnace, a blow pipe including a metal case and a refractory lining having a central axial opening therethrough in communication with said tuyere providing a hot blast flow path through the blow pipe and tuyere and into the furnace, lance support means defining a lance guide opening extending through said metal case and refractory lining at an acute angle to said central axial opening and in the general direction of said open passage into the furnace, said lance support means including mounting means on said metal casing, an elongated lance having an open end, said elongated lance being adapted to be telescopingly received in said lance guide opening and releasably supported by said lance support means with said open end within said hot blast flow path, manually operable quick disconnect coupling means releasably connecting said lance on said lance support means, said coupling means being operable to release said lance to permit withdrawal of the lance from said hot blast flow path, said coupling means including a first coupling element rigidly mounted on said casing, a second coupling element adapted to be releasably connected to said first coupling element, and adapter means connecting said lance and said second coupling element, said lance extending through said first coupling element when said first and second coupling elements are connected, and fuel supply means for supplying supplemental fuel to said lance to be discharged from said open end into said hot blast flow path.

3. The invention defined in claim 2, wherein said quick disconnect coupling means comprises a cam acuated coupling.

4. The invention defined in claim 3 wherein said lance extends through said first and said second coupling elements when said first and said second coupling elements are coupled.

5. In a blast furnace for production of molten iron including a blow pipe connected to a tuyere for supplying a hot blast to the furnace and a supplemental fuel lance extending into the blow pipe for discharging fuel into the hot blast flow path, the method of packing the tuyere comprising, mounting the lance on the blow pipe for telescoping movement into and out of the hot blast flow path, stopping the flow of hot gas along the hot gas flow path, moving the lance from the hot blast flow path before commencing packing the tuyere, packing the tuyere by projecting packing mud through the blow pipe and into the tuyere by use of an elongated manually operable packing tool inserted through an opening in the blow pipe, and compacting the packing mud into the tuyere to complete the seal, and returning the lance into the hot blast flow path.

* * * * *